US006001463A

United States Patent [19]

Shibahara et al.

[11] Patent Number: 6,001,463

[45] Date of Patent: Dec. 14, 1999

[54] IMAGE RECORDING MEDIUM AND IMAGE RECORDING PROCESS

[75] Inventors: Yoshihiko Shibahara; Junichi Yamanouchi, both of Kanagawa, Japan

[73] Assignee: Fuji Photo Film Co., Ltd., Minami-ashigara, Japan

[21] Appl. No.: 08/998,780

[22] Filed: Dec. 29, 1997

[30] Foreign Application Priority Data

Dec. 26, 1996 [JP] Japan ..... 8-348975

[51] Int. Cl.[6] ..... B41M 5/00; B41J 2/01

[52] U.S. Cl. ..... 428/216; 428/195; 428/212; 428/215; 428/323; 428/478.2; 428/522; 428/523; 347/105

[58] Field of Search ..... 428/195, 212, 428/215, 216, 323, 478.2, 522, 523; 347/105

[56] References Cited

U.S. PATENT DOCUMENTS 5,741,584 4/1998 Imabeppu et al. ..... 428/211

*Primary Examiner*—Pamela R. Schwartz

*Attorney, Agent, or Firm*—Birch, Stewart, Kolasch & Birch, LLP

[57] ABSTRACT

An image recording medium comprises a support, a polyolefin layer, a polyvinyl alcohol layer and a surface gelatin layer in the order. The polyolefin layer contains polyolefin in an amount of not less than 50 wt. %. The polyolefin layer has a thickness in the range of 10 to 100 μm. The polyvinyl alcohol layer contains a vinyl alcohol polymer in an amount of not less than 50 wt. %. The vinyl alcohol polymer comprises vinyl alcohol units in an amount of 50 to 90 mole %. The polyvinyl alcohol layer has a thickness in the range of 2 to 20 μm. The surface gelatin layer contains gelatin in an amount of not less than 50 wt. %. The surface gelatin layer has a thickness in the range of 0.2 to 2 μm. The surface gelatin layer further contains solid particles. The solid particles have an average particle size in the range of 3 to 100 μm. The image recording medium is advantageously used in an image recording process according to an ink jet method.

15 Claims, 1 Drawing Sheet

IMAGE RECORDING MEDIUM AND IMAGE RECORDING PROCESS

FIELD OF THE INVENTION

The present invention relates to an image recording medium comprising a support, an ink receiving layer and an ink permeable layer in the order. The invention also relates to an image recording process using the same.

BACKGROUND OF THE INVENTION

With the development of computer technology, an image stored in a conventional recording medium such as a paper or a photograph is now treated in a computer as digital information. With the spread of personal computer, various images are converted into digital information. However, the conventional recording medium is still important. Accordingly, the digital information should be output as a visible image on the recording medium by an image recording process.

An ink jet method is a widespread image recording process for outputting digital information. The ink jet method has an advantage that a color image can be formed by an inexpensive apparatus (printer). It has been considered that the image quality of the ink jet printer is inferior to those of other printers (such as a thermal sublimation transfer method, an electron photographic method, a silver halide photographic method). However, the ink jet printer has recently been improved in resolution and gradation. The image quality of the ink jet printer is now comparable to those of the other printers.

The ink jet method uses an image recording medium. An ordinary paper or an ink jet recording paper has been used as the recording medium. The ink jet recording paper comprises an ink receiving layer provided on a paper (support). With the improvement of the ink jet printer, the conventional image recording medium now cannot exploit the full performance of the improved printer. The conventional image recording medium cannot deal with the high resolution of the improved printer because an ink is blotted in the conventional medium. With the improvement of the image quality, a glossy image like a photograph has recently been required. However, it is difficult to form a glossy image in the conventional image recording medium. Accordingly, the image recording medium should be improved with the improvement of the ink jet method.

The improvement of the image recording medium is proposed in Japanese Patent Provisional Publication Nos. 57(1982)-89954, 60(1985)-224578, 61(1986)-12388, 4(1992)-216990, 6(1994)-64306, 7(1995)-179032 and 8(1996)-24436.

Japanese Patent Provisional Publication No. 57(1982)-89954 discloses a recording material (a liquid absorbing sheet), which comprises a support, a liquid absorbing undercoating layer and a liquid permeable surface layer in the order. Japanese Patent Provisional Publication No. 60(1985)-224578 discloses a recording material (an overhead projector film), which comprises a support (a transparent base film made of a synthetic resin) and a transparent hydrophilic film made of a water-soluble polymer. Japanese Patent Provisional Publication No. 61(1986)-12388 discloses a recording material, which comprises an ink receiving layer and an ink permeable layer.

Japanese Patent Provisional Publication No. 4(1992)-216990 discloses a recording material, which comprises a support, a polyolefin layer and an ink absorbing layer containing gelatin and starch in the order. Japanese Patent Provisional Publication No. 6(1994)-64306 discloses a recording material, which comprises a support, a polyolefin layer and an ink receiving layer containing gelatin in the order. Japanese Patent Provisional Publication No. 7(1995)-179032 discloses a recording material, which comprises a support, a polyolefin layer and an ink receiving layer containing a synthetic hydrophilic resin in the order. Japanese Patent Provisional Publication No. 8(1996)-24436 discloses a recording material, which comprises a support and an ink receiving layer containing gelatin and a basic latex.

SUMMARY OF THE INVENTION

With the improvement of the image recording medium (particularly by a function of a polyolefin layer formed on a support), a glossy image like a photograph can be formed by an ink jet method. However, the improvement in the resolution and graininess of the image is still insufficient. Accordingly, the quality of the image is not comparable to a photograph.

In the case that a picture of a relatively small size is printed on the recording medium by using a high speed ink jet printer, neighboring two inks are sometimes contaminated with each other. In the case of jetting many ink droplets of light color to the recording medium, the image is sometimes degraded, and the ink is transferred to another paper or the like. If water droplets are attached to the formed image, the image is blotted or discolored.

An object of the present invention is to provide an image recording medium that can be advantageously used in an ink jet method.

Another object of the invention is to provide an image forming process that can form an image of high quality improved in the resolution and graininess.

The present invention provides an image recording medium which comprises a support, a polyolefin layer, a polyvinyl alcohol layer and a surface gelatin layer in the order, said polyolefin layer containing polyolefin in an amount of not less than 50 wt. %, said polyolefin layer having a thickness in the range of 10 to 100 $\mu$m, said polyvinyl alcohol layer containing a vinyl alcohol polymer in an amount of not less than 50 wt. %, said vinyl alcohol polymer comprising vinyl alcohol units in an amount of 50 to 90 mole %, said polyvinyl alcohol layer having a thickness in the range of 2 to 20 $\mu$m, said surface gelatin layer containing gelatin in an amount of not less than 50 wt. %, said surface gelatin layer having a thickness in the range of 0.2 to 2 $\mu$m, said surface gelatin layer further containing solid particles, and said solid particles having an average particle size in the range of 3 to 100 $\mu$m.

The invention also provides an image recording process comprising imagewise attaching an aqueous ink onto the surface gelatin layer of the above-defined image recording medium, whereby the applied aqueous ink penetrates into the surface gelatin layer and the polyvinyl alcohol layer and the ink is fixed in the polyvinyl alcohol layer to record an image in the image recording medium.

The image recording medium of the present invention is characterized in that the polyvinyl alcohol layer functions as an ink receiving layer and the surface gelatin layer functions as an ink permeable (and protective) layer.

According to study of the present inventor, an image of high quality improved in resolution and graininess can be recorded by an ink penetrating into the surface gelatin layer and the polyvinyl alcohol layer and fixed in the polyvinyl alcohol layer. However, the surface gelatin layer has a problem that the surface is sticky. Accordingly, the solid particles having an average particle size in the range of 3 to 100 μm (which function as a matting agent) are added to the surface gelatin layer to solve the problem.

Though gelatin and the vinyl alcohol polymer are classified as hydrophilic polymers, the affinity between gelatin and the vinyl alcohol polymer is relatively low. Accordingly, the coated surface of the image recording medium is sometimes degraded. The degradation of the coated surface can be prevented by formation of two or more gelatin layers or two or more polyvinyl alcohol layers.

DETAILED DESCRIPTION OF THE INVENTION

[Layered structure]

Figure 1:
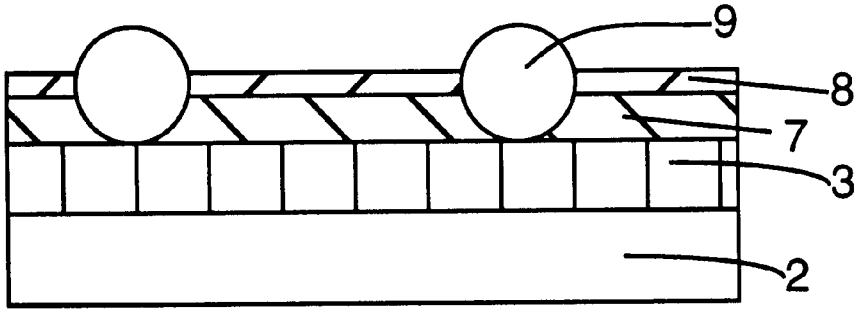
FIG. 1 is a sectional view schematically illustrating the simplest embodiment of the image recording medium.

Layered structures (1) to (6) are shown below. In the following structures, the main component means the component contained in the layer in an amount of not less than 50 wt. %, and the PVA means polyvinyl alcohol polymer.

| | Main component | Thickness |
|---|---|---|
| Layered structure (1) | | |
| Surface gelatin layer | Gelatin | 0.2 to 2 μm |
| Polyvinyl alcohol layer | PVA | 2 to 20 μm |
| Polyolefin layer | Polyolefin | 10 to 100 μm |
| | Support | |
| Layered structure (2) | | |
| Surface gelatin layer | Gelatin | 0.2 to 2 μm |
| Polyvinyl alcohol layer | PVA | 2 to 20 μm |
| Second polyvinyl alcohol layer | PVA | 2 to 20 μm |
| Polyolefin layer | Polyolefin | 10 to 100 μm |
| | Support | |
| Layered structure (3) | | |
| Surface gelatin layer | Gelatin | 0.2 to 2 μm |
| Polyvinyl alcohol layer | PVA | 2 to 20 μm |
| Intermediate gelatin layer | Gelatin | 0.2 to 2 μm |
| Second polyvinyl alcohol layer | PVA | 2 to 20 μm |
| Polyolefin layer | Polyolefin | 10 to 100 μm |
| | Support | |
| Layered structure (4) | | |
| Surface gelatin layer | Gelatin | 0.2 to 2 μm |
| Polyvinyl alcohol layer | PVA | 2 to 20 μm |
| Undercoating gelatin layer | Gelatin | 0.5 to 5 μm |
| Polyolefin layer | Polyolefin | 10 to 100 μm |
| | Support | |
| Layered structure (5) | | |
| Surface gelatin layer | Gelatin | 0.2 to 2 μm |
| Polyvinyl alcohol layer | PVA | 2 to 20 μm |
| Second polyvinyl alcohol layer | PVA | 2 to 20 μm |
| Undercoating gelatin layer | Gelatin | 0.5 to 5 μm |
| Polyolefin layer | Polyolefin | 10 to 100 μm |
| | Support | |
| Layered structure (6) | | |
| Surface gelatin layer | Gelatin | 0.2 to 2 μm |
| Polyvinyl alcohol layer | PVA | 2 to 20 μm |
| Intermediate gelatin layer | Gelatin | 0.2 to 2 μm |
| Second polyvinyl alcohol layer | PVA | 2 to 20 μm |
| Undercoating gelatin layer | Gelatin | 0.5 to 5 μm |

-continued

| | Main component | Thickness |
|---|---|---|
| Polyolefin layer | Polyolefin | 10 to 100 μm |
| | Support | |

The simplest layered structure is illustrated in FIG. 1. As is shown in FIG. 1, the image recording medium comprises a support (2), a polyolefin layer (3), a polyvinyl alcohol layer (7) and a surface gelatin layer (8) in the order. The image recording medium further contains solid particles (9).

Figure 2:
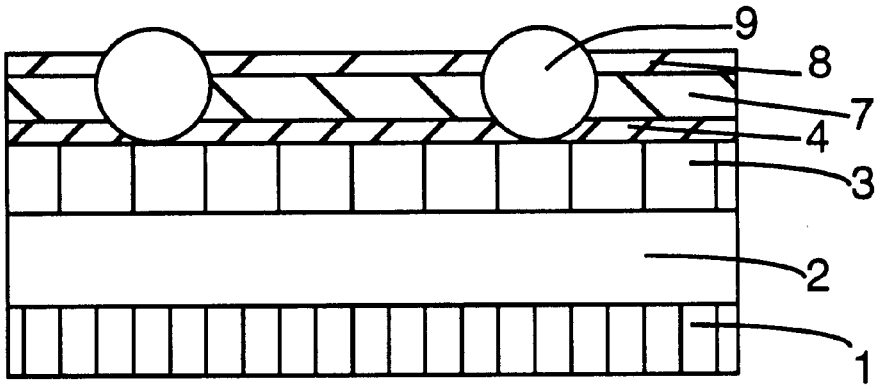
FIG. 2 is a sectional view schematically illustrating a preferred embodiment of the image recording medium.

A preferred layered structure is illustrated in FIG. 2. As is shown in FIG. 2, the image recording medium comprises a backing polyolefin layer (1), a support (2), a polyolefin layer (3), an undercoating gelatin layer (4), a polyvinyl alcohol layer (7) and a surface gelatin layer (8) in the order. The image recording medium further contains solid particles (9).

Figure 3:
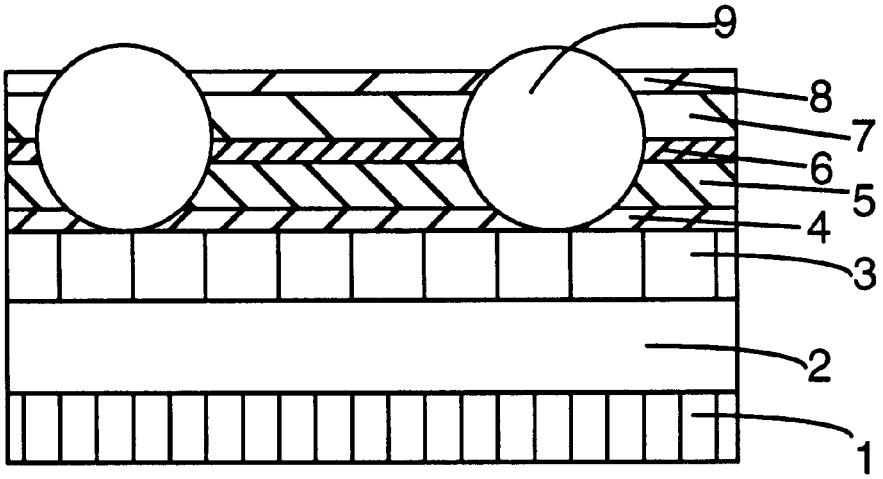
FIG. 3 is a sectional view schematically illustrating the most preferred embodiment of the image recording medium.

The most preferred layered structure is illustrated in FIG. 3. As is shown in FIG. 3, the image recording medium comprises a backing polyolefin layer (1), a support (2), a polyolefin layer (3), an undercoating gelatin layer (4), a second polyvinyl alcohol layer (5), an intermediate gelatin layer (6), a polyvinyl alcohol layer (7) and a surface gelatin layer (8) in the order. The image recording medium further contains solid particles (9).

The total thickness of the hydrophilic (gelatin or polyvinyl alcohol) layers provided on the polyolefin layer is preferably in the range of 5 to 27 μm, and more preferably in the range of 8 to 20 μm. The total swelling ratio of the hydrophilic layers provided on the polyolefin layer in water is preferably in the range of 100 to 300%, and more preferably in the range of 150 to 250%. The swelling ratio means the swelling value (obtained by subtracting the dry thickness from the swelled thickness) per the dry thickness. The swelled thickness is measured after immersing the image recording medium in water at 25° C. for 3 minutes. The swelling ratio is preferably adjusted to control penetration or spread of ink to protect the medium from scratch caused in a printer.

The hydrophilic layers are preferably formed by coating solutions of the layers simultaneously on the polyolefin layer.

The layers, the components and the image recording method are described below.

[Surface gelatin layer]

The surface gelatin layer is an ink permeable layer (or a protective layer) containing gelatin as a binder. The layer contains gelatin in an amount of not less than 50 wt. %. The amount of gelatin is preferably not less than 55 wt. %, and more preferably not less than 60 wt. %. The surface gelatin layer further contains solid particles having an average particle size in the range of 3 to 100 μm as a matting agent. The surface gelatin layer preferably furthermore contains a surface active agent.

The surface gelatin layer has a function of controlling spread or penetration of an ink. The surface gelatin layer has another function of protecting physically or chemically a color image fixed in a polyvinyl alcohol layer.

The surface gelatin layer has a thickness in the range of 0.2 to 2 μm. The thickness is preferably in the range of 0.3 to 1 μm.

[(First) Polyvinyl alcohol layer]

The first polyvinyl alcohol layer is an ink receiving layer (or an image fixing layer) containing a vinyl alcohol polymer as a binder. The layer contains the vinyl alcohol polymer in an amount of not less than 50 wt. %. The amount of the vinyl alcohol polymer is preferably not less than 55 wt. %, and more preferably not less than 60 wt. %. The vinyl alcohol polymer of the first polyvinyl alcohol layer preferably has a relatively high polymerization degree of not less than 1,000. The first polyvinyl alcohol layer preferably contains a polymer mordant in addition to the vinyl alcohol polymer.

The first polyvinyl alcohol layer has a thickness in the range of 2 to 20 μm. The thickness is preferably in the range of 3 to 20 μm, more preferably in the range of 5 to 15 μm, and most preferably in the range of 7 to 15 μm.

[Intermediate gelatin layer]

The intermediate gelatin layer is an intermediate layer containing gelatin as a binder provided between the first polyvinyl alcohol layer and the second polyvinyl alcohol layer. The layer contains gelatin in an amount of not less than 50 wt. %. The amount of gelatin is preferably not less than 55 wt. %, and more preferably not less than 60 wt. %.

The intermediate gelatin layer has the same function as the function of the surface gelatin layer and the undercoating gelatin layer. The intermediate gelatin layer has another function of preventing degradation of the coated surface of the image recording medium.

The intermediate gelatin layer has a thickness in the range of 0.2 to 2 μm. The thickness is preferably in the range of 0.3 to 1 μm.

[Second polyvinyl alcohol layer]

The second polyvinyl alcohol layer is an ink receiving layer (or an image fixing layer) containing a vinyl alcohol polymer as a binder. The degradation of the coated surface of the image recording medium can be prevented by formation of the second polyvinyl alcohol layer. The layer contains the vinyl alcohol polymer in an amount of not less than 50 wt. %. The amount of the vinyl alcohol polymer is preferably not less than 55 wt. %, and more preferably not less than 60 wt. %. The vinyl alcohol polymer of the second polyvinyl alcohol layer preferably has a relatively low polymerization degree of less than 1,000. The second polyvinyl alcohol layer preferably contains a polymer mordant in addition to the vinyl alcohol polymer.

The second polyvinyl alcohol layer has a thickness in the range of 2 to 20 μm. The thickness is preferably in the range of 3 to 20 μm, more preferably in the range of 5 to 15 μm, and most preferably in the range of 7 to 15 μm.

[Undercoating gelatin layer]

The undercoating gelatin layer is an undercoating layer containing gelatin as a binder provided between the first or second polyvinyl alcohol layer and the polyolefin layer. The layer contains gelatin in an amount of not less than 50 wt. %. The amount of gelatin is preferably not less than 55 wt. %, and more preferably not less than 60 wt. %.

The undercoating gelatin layer preferably contains a brightening agent in addition to gelatin. The undercoating gelatin layer has a function of controlling a swelling ratio or a curl balance.

The undercoating gelatin layer has a thickness in the range of 0.5 to 5 μm. The thickness is preferably in the range of 0.7 to 3 μm.

[Polyolefin layer]

The polyolefin layer is a layer containing a polyolefin as a binder provided on a support. The layer contains a polyolefin in an amount of not less than 50 wt. %. The amount of the polyolefin is preferably not less than 55 wt. %, and more preferably not less than 60 wt. %.

Examples of the polyolefins include polyethylene, polystyrene and polybutene. A copolymer can also be used as the polyolefin. Polyethylene is most preferred.

The polyolefin layer can be formed on the support by coating or lamination.

The polyolefin layer preferably contains a white pigment or a coloring dye or pigment.

The white pigment preferably is titanium oxide or zinc oxide, and more preferably is titanium oxide of an anatase type. Zinc oxide can be used with titanium oxide of an anatase type to disperse titanium oxide finely. In the mixture, the amount of zinc oxide is preferably not more than 50 wt. %. The amount of the white pigment in the polyolefin layer is preferably in the range of 5 to 50 wt. %, more preferably in the range of 10 to 50 wt. %, and most preferably in the range of 15 to 30 wt. %.

The polyolefin layer can be colored with a dye or pigment to control the surface reflectance. The dye or pigment preferably has a heat resistance at a temperature of coating the polyolefin layer (usually higher than 300° C.). Examples of the preferred dyes and pigments include cobalt blue, ultramarine and neodymium oxide. The amount of the coloring dye or pigment is preferably in the range of 0.1 to 3 wt. % based on the amount of the white pigment. The surface reflectance of the support can be controlled by adjusting the kind and amount of the coloring dye or pigment.

The polyolefin layer has a thickness in the range of 10 to 100 μm. The thickness is preferably in the range of 15 to 50 μm, and more preferably in the range of 20 to 35 μm. The surface of the polyolefin layer is preferably polished to form a mirror surface. Before forming the abovementioned hydrophilic layers, the surface of the polyolefin layer can be subjected to a surface active treatment (e.g., a corona discharge treatment, a flame treatment).

[Support]

A paper or a plastic film is preferably used as the support. A paper is preferred to a plastic film.

The support has a thickness preferably in the range of 50 to 300 μm, and more preferably in the range of 100 to 200 μm.

[Other optional layers]

A polyolefin backing layer is preferably provided on the other (backing) surface of the support. The details of the polyolefin backing layer are the same as those of the polyolefin layer provided between the support and the hydrophilic layers.

A backing layer preferably has an antistatic function. The surface resistance of the backing layer preferably is not more than $10^{12}\Omega\cdot$cm.

[Gelatin]

In the present specification, the term "gelatin" include gelatin derivatives as well as normal (not modified) gelatin.

Gelatin is preferably cross-linked (hardened) by using a hardening agent described below.

[Hardening agent]

The hardening agent is classified into a low molecular hardening agent and a polymer hardening agent.

Examples of the low molecular hardening agents include aldehyde compounds (e.g., formaldehyde, glyoxal, glutaraldehyde), aziridine compounds, isooxazole compounds, epoxy compounds, vinylsulfone compounds (e.g., 1,3,5-tri-acryloyl-hexahydro-s-triazine, bis (vinylsulfonyl)methyl ether, N,N'-ethylene-bis (vinylsulfonylacetamido)ethane), N,N'-trimethylene-bis (vinylsulfonylacetamide)), acryloyl compounds, carbodiimide compounds, triazine compounds (e.g., 2,4-dichloro-6-hydroxy-s-triazine), N-methylol compounds (e.g., dimethylol urea, methylol dimethylhydantoin), dioxane derivatives (e.g., 2,3-dihydroxydioxane), mucohalogeno acids (e.g., mucochloric acid, mucophenoxychloric acid), dialdehyde starch, 1-chloro-6-hydroxytriazinyl gelatin, maleimide compounds, acetylene compounds and methanesulfonic esters.

The aziridine compounds are described in PB report No. 19,921, U.S. Pat. Nos. 2,950,197, 2,964,404, 2,983,611, 3,271,175, Japanese Patent Publication No. 46(1971)-40898 and Japanese Patent Provisional Publication No. 50(1975)-91315. The isooxazole compounds are described in U.S. Pat. No. 331,609. The epoxy compounds are described in U.S. Pat. No. 3,047,394, German Patent No. 1,035,663, British Patent No. 1,033,518 and Japanese Patent Publication No. 48(1973)-35495. The vinylsulfone compounds are described in PB report No. 19,920, German Patent Nos. 1,100,942, 2,337,412, 2,545,722, 2,635,518, 2,742,308, 2,749,260, British Patent No. 1,251,091, and U.S. Pat. Nos. 3,490,911, 3,539,644. The acryloyl compounds are described in U.S. Pat. No. 3,640,720. The carbodiimide compounds are described in U.S. Pat. Nos. 2,938,892, 4,043,818, 4,061,499, and Japanese Patent Publication No. 46(1971)-38715. The triazine compounds are described in German Patent Nos. 2,410,973, 2,553,915, U.S. Pat. No. 3,325,287, and Japanese Patent Publication No. 52(1977)-12722.

Examples of the polymer hardening agents include a polymer having an aldehyde group such as an acrolein copolymer (described in U.S. Pat. No. 3,396,029), a polymer having a dichlorotriazine group (described in U.S. Pat. No. 3,262,827, and Research Disclosure No. 17,333 (1978)), a polymer having an epoxy group (described in U.S. Pat. No. 3,623,878), a polymer having an active vinyl group or a precursor group thereof (described in Research Disclosure No. 16,725 (1978), U.S. Pat. No. 4,161,407, and Japanese Patent Provisional Publication Nos. 54(1979)-65033, 56(1981)-142524) and a polymer having an active ester group (described in Japanese Patent Provisional Publication No. 56(1981)-66841).

The amount of the hardening agent is preferably in the range of 0.1 to 30 wt. %, and more preferably in the range of 0.5 to 10 wt. % based on the amount of gelatin. The low molecular hardening agent can be diffused from one gelatin layer to other gelatin layers. Accordingly, all gelatin layers can be hardened by adding a hardening agent to one of gelatin layers.

[Vinyl alcohol polymer]

The vinyl alcohol polymer comprises vinyl alcohol repeating units in an amount of 50 to 90 mole %. Accordingly, the vinyl alcohol polymer has a saponification degree of 50 to 90 mole %. A polyvinyl alcohol used in an ink jet recording paper usually has a saponification degree of more than 90 mole %. The applicants note that the saponification degree is preferably not more than 90 mole % to prevent two or more inks from being contaminated with each other. The saponification degree (ratio of the vinyl alcohol repeating units) is preferably in the range of 60 to 90 mole %, and more preferably in the range of 65 to 80 mole %.

The vinyl alcohol polymer may further comprise other repeating units derived from ethylenically unsaturated monomer. Examples of the ethylenically unsaturated monomers include acrylic esters, methacrylic esters, acrylamide, methacrylamide, olefins, vinyl ethers, unsaturated aliphatic acids (e.g., acrylic acid, methacrylic acid, itaconic acid) and vinyl esters (e.g., vinyl propionate, vinyl pivalate). An alkylthio group or an arylthio group may be attached to the end of the vinyl alcohol polymer. The alkylthio group or the arylthio group preferably contains 8 or more carbon atoms.

The vinyl alcohol polymer preferably is polyvinyl alcohol consists of vinyl alcohol repeating units and vinyl acetate repeating units.

The vinyl alcohol polymer of the first polyvinyl alcohol layer preferably has a polymerization degree of not less than 1,000, more preferably in the range of 1,000 to 5,000, and most preferably in the range of 1,500 to 3,000. The vinyl alcohol polymer of a relatively high molecular weight is preferably used to shorten the drying time of an ink or to prevent the surface from forming a contact mark (caused by a contact of fingers or the like), since the first polyvinyl alcohol layer provided just under the surface gelatin layer.

The vinyl alcohol polymer of the second polyvinyl alcohol layer preferably has a polymerization degree of less than 1,00, more preferably in the range of 300 to 1,000, and most preferably in the range of 400 to 800. The viscosity of the coating solution of the second polyvinyl alcohol layer is preferably decreased to coat various layers simultaneously. Accordingly, a vinyl alcohol polymer of a relatively low molecular weight is preferably used in the second polyvinyl alcohol layer.

[Polymer mordant]

The first and second polyvinyl alcohol layers preferably contain a polymer mordant.

The polymer mordant usually is a vinyl polymer having a tertiary amino group or a vinyl polymer having a nitrogen-containing heterocyclic group. The tertiary amino group or the nitrogen-containing heterocyclic group can be in the form of a quarternary ammonium.

A vinyl polymer having a nitrogen-containing heterocyclic group is preferably used as the polymer mordant. The nitrogen-containing heterocyclic group preferably is a tertiary imidazole group. A repeating unit having the tertiary imidazole group is represented by the formula (I):

(I)

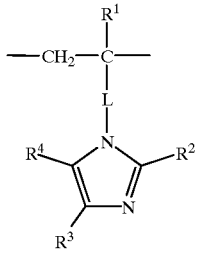

in which each of $R^1$, $R^2$, $R^3$ and $R^4$ independently is hydrogen or an alkyl group having 1 to 6 carbon atoms; L is a single bond or a divalent linking group selected from the group consisting of an alkylene group, an arylene group, —CO—, —O—, —NH— and a combination thereof.

In the formula (I), each of $R^1$, $R^2$, $R^3$ and $R^4$ preferably is hydrogen, methyl or ethyl, and more preferably is hydrogen or methyl.

In the formula (I), the alkylene group preferably has 1 to 6 carbon atoms. The arylene group preferably is phenylene.

Examples of the combinations of an alkylene group, an arylene group, —CO—, —O— and —NH— are shown below. In the following $L^1$ to $L^5$, the left side is attached to the main chain, and the right side is attached to the imidazole ring.

$L^1$: -(an arylene group)-(an alkylene group)-

$L^2$: —CO—O—

$L^3$: —CO—NH—

$L^4$: —CO—O—(an alkylene group)-

$L^5$: —CO—NH—(an alkylene group)-

Examples of the repeating units having a tertiary imidazole group are shown below.

(1)

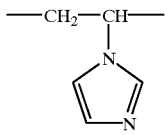

(2)

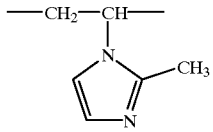

(3)

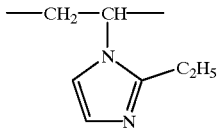

(4)

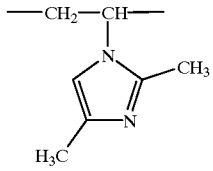

(5)

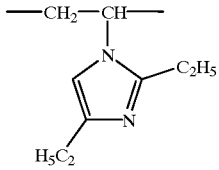

(6)

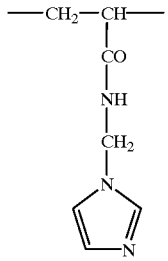

(7)

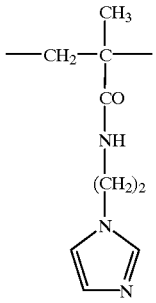

-continued (8)

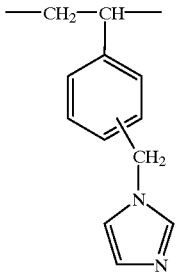

(9)

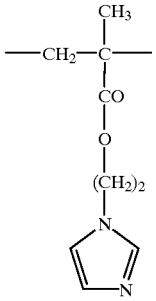

(10)

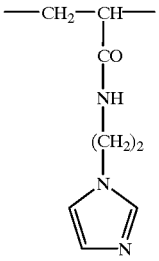

A homopolymer consisting of repeating units having a tertiary imidazole group can be used as the polymer mordant. A copolymer consisting of two or more kinds of repeating units having tertiary imidazole groups can also be used as the polymer mordant. Further, a copolymer consisting of repeating units having a tertiary imidazole group and other repeating units can be used as the polymer mordant. The copolymer preferably contains the repeating units having a tertiary imidazole group in an amount of not less than 50 mole %, and more preferably of not less than 60 mole %. Examples of the other repeating units are shown below.

(21)

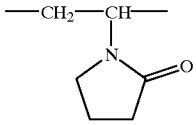

(22)

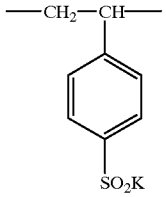

-continued
(23)
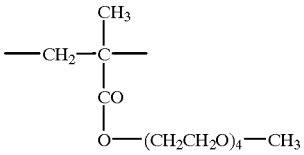
(24)
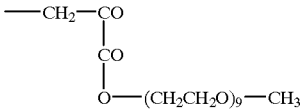
(25)
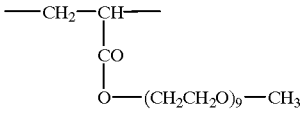
(26)
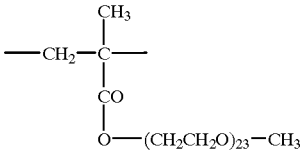
(27)
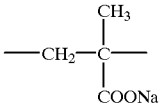
(28)
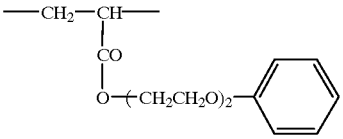
(29)
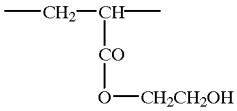
(30)
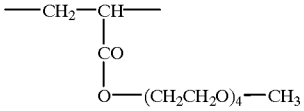
(30)
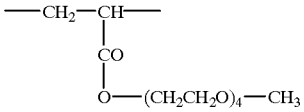
(31)
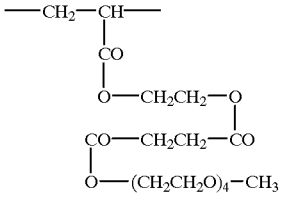
(32)
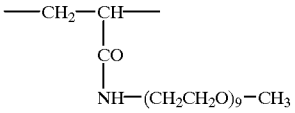
(33)
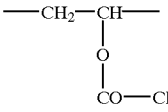
(34)
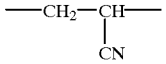
(35)
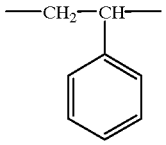
(36)
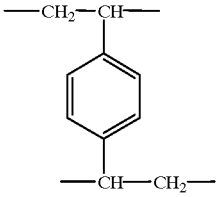
(37)
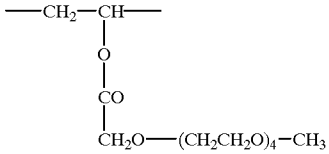
(38)
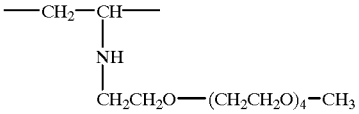
(39)
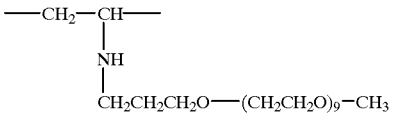
(40)
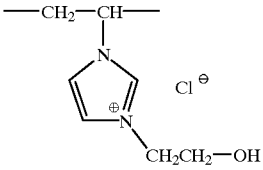
(41)
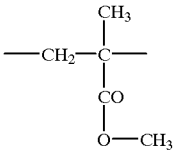

-continued (42)

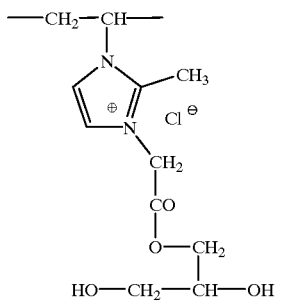

(43)

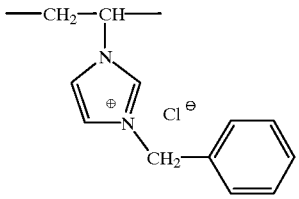

Examples of the copolymers consisting of the repeating units having a tertiary imidazole group and the other repeating units are shown below. In the following examples, the number in the parentheses means the repeating unit number described above. The number shown at the right side of the parentheses means the mole % of the repeating unit.

| Copolymer | t-Imidazole | Second unit | Third unit |
|---|---|---|---|
| CPM-1 | $-(1)_{50}-$ | $-(21)_{50}-$ | None |
| CPM-2 | $-(1)_{90}-$ | $-(22)_{10}-$ | None |
| CPM-3 | $-(1)_{95}-$ | $-(22)_{5}-$ | None |
| CPM-4 | $-(1)_{95}-$ | $-(21)_{5}-$ | $-(22)_{5}-$ |
| CPM-5 | $-(1)_{95}-$ | $-(23)_{5}-$ | None |
| CPM-6 | $-(1)_{95}-$ | $-(24)_{5}-$ | None |
| CPM-7 | $-(1)_{95}-$ | $-(25)_{5}-$ | None |
| CPM-8 | $-(2)_{95}-$ | $-(26)_{5}-$ | None |
| CPM-9 | $-(7)_{95}-$ | $-(23)_{5}-$ | None |
| CPM-10 | $-(10)_{90}-$ | $-(25)_{5}-$ | $-(27)_{5}-$ |
| CPM-11 | $-(8)_{90}-$ | $-(28)_{5}-$ | $-(29)_{5}-$ |
| CPM-12 | $-(1)_{90}-$ | $-(30)_{5}-$ | $-(22)_{5}-$ |
| CPM-13 | $-(1)_{90}-$ | $-(24)_{5}-$ | $-(22)_{5}-$ |
| CPM-14 | $-(1)_{95}-$ | $-(31)_{5}-$ | None |
| CPM-15 | $-(1)_{90}-$ | $-(32)_{5}-$ | $-(22)_{5}-$ |
| CPM-16 | $-(10)_{90}-$ | $-(26)_{5}-$ | $-(22)_{5}-$ |
| CPM-17 | $-(1)_{62.5}-$ | $-(21)_{31.25}-$ | $(22)_{6.25}-$ |
| CPM-18 | $-(1)_{50}-$ | $-(33)_{50}-$ | None |
| CPM-19 | $-(1)_{75}-$ | $-(22)_{25}-$ | None |
| CPM-20 | $-(1)_{60}-$ | $-(21)_{30}-$ | $-(22)_{10-}$ |
| CPM-21 | $-(1)_{60}-$ | $-(34)_{40}-$ | None |
| CPM-22 | $-(8)_{80}-$ | $-(35)_{15}-$ | $-(36)_{5}-$ |
| CPM-23 | $-(1)_{70}-$ | $-(23)_{30}-$ | None |
| CPM-24 | $-(1)_{70}-$ | $-(24)_{20}-$ | $-(22)_{10}-$ |
| CPM-25 | $-(1)_{80}-$ | $-(24)_{20}-$ | None |
| CPM-26 | $-(1)_{65}-$ | $-(37)_{35}-$ | None |
| CPM-27 | $-(1)_{70}-$ | $-(38)_{30}-$ | None |
| CPM-28 | $-(1)_{65}-$ | $-(39)_{25}-$ | $-(22)_{10}-$ |
| CPM-29 | $-(1)_{90}-$ | $-(40)_{10}-$ | None |
| CPM-30 | $-(2)_{25}-$ | $-(41)_{50}-$ | $-(42)_{25}-$ |
| CPM-31 | $-(1)_{35}-$ | -(34)50- | $-(43)_{15}-$ |

Two or more polymer mordants can be used in combination.

The polymer mordant has a molecular weight preferably in the range of 1,000 to 1,000,000, and more preferably in the range of 10,000 to 200,000.

The amount of the polymer mordant is preferably in the range of 0.2 to 30 g per $m^2$, and more preferably in the range of 0.5 to 15 g per $m^2$.

[Solid particles of 3 to 100 μm]

The solid particles having an average particle size in the range of 3 to 100 μm are added to the surface gelatin layer. The solid particles function as a matting agent. The thickness of the surface gelatin layer (0.2 to 2 μm) is smaller than the particle size of the solid particles (3 to 100 μm). Accordingly, the solid particles can be present not only in the surface gelatin layer but also in the other hydrophilic layers (provided between the polyolefin layer and the surface gelatin layer), as is shown in FIGS. 1 to 3. In other words, the solid particles can be present at the interface between the surface gelatin layer and the first polyvinyl alcohol layer. The hydrophilic layers provided on the polyolefin layer are usually formed by simultaneously coating. Accordingly, the solid particles can be incorporated into the surface gelatin layer by adding the particles to a coating solution of any one of the hydrophilic layers. The solid particles are preferably added to the coating solution of the surface gelatin layer.

The average particle size is preferably in the range of 10 to 100 μm, and more preferably in the range of 10 to 30 μm.

The solid particles can be classified into inorganic particles and organic particles.

The inorganic particles are made of an inorganic substance. Examples of the inorganic substances include oxides (e.g., silicon dioxide, titanium oxide, magnesium oxide, aluminum oxide), alkaline earth metal salts (e.g., barium sulfate, calcium carbonate, magnesium sulfate), silver halide (e.g., silver chloride, silver bromide) and glass.

Inorganic matting agents are described in German Patent No. 2,529,321, British Patent Nos. 760,775, 1,260,772, and U.S. Pat. Nos. 1,201,905, 2,192,241, 3,053,662, 3,062,649, 3,257,206, 3,322,555, 3,352,958, 3,370,951, 3,411,907, 3,437,484, 3,523,022, 3,615,554, 3,635,714, 3,769,020, 4,021,245, 4,029,504.

The organic particles are made of an organic substance. Examples of the organic substances include starch, cellulose esters (e.g., cellulose acetate propionate), cellulose ethers (e.g., ethyl cellulose) and synthetic resins. The synthetic resins are preferably water-insoluble or slightly soluble in water. Examples of the synthetic resins include poly(meth) acrylic esters (e.g., polyalkyl (meth)acrylate, polyalkoxyalkyl (meth)acrylate, polyglycidyl (meth)acrylate), poly (meth)acrylamides, polyvinyl esters (e.g., polyvinyl acetate), polyacrylonitriles, polyolefins (e.g., polyethylene), polystyrenes, benzoguanamine resins, formaldehyde condensation polymers, epoxy resins, polyamides, polycarbonates, phenol resins, polyvinyl carbazoles and polyvinylidene chlorides. The organic particles can be made of a copolymer consisting of two or more repeating units contained in the above-mentioned polymers.

The copolymer can contain a small amount of hydrophilic repeating units derived from hydrophilic monomers. Examples of the hydrophilic monomers include acrylic acid, methacrylic acid, (α,β-unsaturated dicarboxylic acids, hydroxyalkyl (meth)acrylates, sulfoalkyl (meth)acrylates and styrenesulfonic acids.

Organic matting agents are described in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924, 3,767,448, and Japanese Patent Provisional Publication Nos. 49(1974)-106821, 57(1982)-14835.

Two or more solid particles can be used in combination. The amount of the solid particles is preferably in the range of 0.01 to 0.5 g per $m^2$, and more preferably in the range of 0.02 to 0.3 g per $m^2$.

[Solid particles of less than 3 μm]

The gelatin or polyvinyl alcohol layers can further contain solid fine particles having an average particle size of less than 3 μm. The solid fine particles can be used to adjust the rate of absorbing an ink, to inhibit adhesion, to improve strength of the layer or to improve a curl balance.

Inorganic pigments are preferably used as the solid fine particles. Examples of the inorganic pigments include silica pigments, alumina pigments, titanium dioxide pigments, zinc oxide pigments, zirconium oxide pigments, mica iron oxide, white lead, lead oxide pigments, cobalt oxide pigments, strontium chromate, molybdenum pigments, smectite, magnesium oxide pigments, calcium oxide pigments, calcium carbonate pigments and mullite. Silica pigments and alumina pigments are preferred. Two or more pigments can be used in combination.

The silica pigments are classified into spherical silica and amorphous silica. The silica pigments can be synthesized by a dry method, a wet method or an aerogel method. Hydrophobic silica particles can be subjected to a surface treatment with trimethylsilyl group or silicone. The silica pigments have an average particle size preferably in the range of 4 to 120 nm, and more preferably in the range of 4 to 90 nm. The silica pigments preferably have a porous surface. The average pore size of the porous pigments is preferably in the range of 50 to 500 Å. The average volume of the pores based on the weight of the porous pigments is preferably in the range of 0.5 to 3 ml per g.

The alumina pigments include alumina anhydride and alumina hydrate. Crystal types of the alumina anhydrides include α-type, β-type, γ-type, δ-type, ζ-type, η-type, θ-type, κ-type, ρ-type and χ-type. The alumina hydrates include alumina monohydrate and alumina trihydrate. Examples of the alumina monohydrates include pseudoboehmite, boehmite and diaspore. Examples of the alumina trihydrates include gibbsite and bayerite. The alumina pigments have an average particle size preferably in the range of 4 to 300 nm, and more preferably in the range of 4 to 200 nm. The alumina pigments preferably have a porous surface. The average pore size of the porous pigments is preferably in the range of 50 to 500 Å. The average volume of the pores based on the weight of the porous pigments is preferably in the range of 0.5 to 3 ml per g. The alumina hydrates can be synthesized by a sol-gel method or a hydrolysis method. According to the sol-gel method, ammonia is added to an aluminum salt solution to precipitate an aluminum hydrate. According to the hydrolysis method, an alkali aluminate is hydrolyzed to obtain an aluminum hydrate. The alumina anhydride can be obtained by heating the aluminum hydrate to dehydrate it.

The amount of the inorganic pigments is preferably in the range of 5 to 100 wt. %, and more preferably in the range of 20 to 70 wt. % based on the dry weight of the binder (gelatin or vinyl alcohol polymer) of the layer.

[Surface active agent]

The gelatin or vinyl alcohol layers can further contain a surface active agent. The surface active agent can function as a coating aid, an antistatic agent, a slipping agent, an emulsifying or dispersing agent or an adhesion inhibitor. A nonionic, anionic, cationic or amphoteric surface active agent can be used in each of the layers.

Examples of the nonionic surface active agents include steroid (e.g., saponin), alkyleneoxide derivatives (e.g., polyethylene glycol, polyethylene glycol/polypropylene glycol condensate, polyethylene glycol alkyl ether, polyethylene glycol alkyl aryl ether, polyethylene glycol ester, polyethylene glycol sorbitan ester, polyalkylene glycol alkylamine, polyalkylene glycol alkylamides, polyethylene oxide adducts of silicone), glycidol derivatives (e.g., polyglyceride alkenylsuccinate, alkylphenol polyglyceride) and alkyl esters (e.g., fatty acid ester of polyhydric alcohol).

Examples of the anionic surface active agents include alkylcarboxylic salts, alkylsulfonic salts, alkylbenzenesulfonic salts, alkylnaphthalenesulfonic salts, alkylsulfuric esters, alkylphosphoric esters, N-acyl-N-alkyltaurine, sulfosuccinic esters, sulfoalkylpolyoxyethylene alkylphenyl ether and polyoxyethylene alkyleicosanoic ester.

Examples of the cationic surface active agents include alkylamine salts, aliphatic or aromatic tertiary ammonium salts, heterocyclic tertiary ammonium salts, phosphonium salts and sulfonium salts.

Examples of the amphoteric surface active agents include amino acids, aminoalkylsulfonic acids, aminoalkylsulfuric acids, alkylbetaine and amine oxide.

The amount of the surface active agent is preferably in the range of 0.005 to 0.5 g per $m^2$, and more preferably in the range of 0.01 to 0.1 g per $m^2$.

[Slipping agent]

A slipping agent can be added to the image recording medium.

Examples of the slipping agents include sodium higher alkylsulfate, higher fatty acid esters of higher alcohols, carbo wax, higher alkyl phosphoric esters and silicone compounds.

The slipping agents are described in U.S. Pat. Nos. 2,882,157, 3,121,060, 3,850,640, French Patent No. 2,180,465, British Patent Nos. 955,061, 1,143,118, 1,263,722, 1,270,578, 1,320,564, 1,320,757, 2,588,765, 2,739,891, 3,018,178, 3,042,522, 3,080,317, 3,082,087, 3,121,060, 3,222,178, 3,295,979, 3,489,567, 3,516,832, 3,658,573, 3,679,411, 3,870,521, Japanese Patent Provisional Publication Nos. 49(1974)-5017, 51(1976)-141623, 54(1979)-159221, 56(1981)-81841, and Research Disclosure No. 13,969.

The amount of the slipping agent is preferably in the range of 5 to 200 mg per $m^2$.

[Antiseptics]

Antiseptics (antimicrobial agent, fungicide) can be added to the coating layers of the image recording medium, particularly to the gelatin layers.

The antiseptics are preferably soluble in water. Examples of the water-soluble antiseptics include thiazolylbenzimidazole compounds, isothiazolone compounds, chlorophenol compounds, bromophenol compounds, thiocyanic compounds, isothiocyanic compounds, acid azide compounds, diazine compounds, triazine compounds, thiourea compounds, alkylguanidine compounds, tertiary ammonium salts, organic tin compounds, organic zinc compounds, cyclohexylphenol compounds, imidazole compounds, benzimidazole compounds, sulfamide compounds, active halogen compounds (e.g., chlorinated sodium isocyanurate), chelating agents, sulfite compounds and antibiotics (e.g., penicillin). The antiseptics are described in L.E. West, Water Quality Criteria, Phot. Sci. and Eng., Vol. 9, No. 6 (1965), Japanese Patent Provisional Publication Nos. 55(1980)-111942, 57(1982)-8542, 57(1982)-157244, 58(1983)-105145, 59(1984)-126533, and Hiroshi Horiguchi, Chemistry of Antiseptics and Fungicides (written in Japanese), Sankyo Publication Co., Ltd., (1982).

[High boiling point organic solvent]

The high boiling point organic solvent can be added to the coating layers of the image recording medium. The high boiling point organic solvent can function as a plasticizer, a slipping agent or an anticurl agent. The high boiling point organic solvent is described in Japanese Patent Provisional Publication No. 62(1987)-245253.

A silicone oil (e.g., dimethylsilicone oil, denatured silicone oil formed by introducing organic groups into dimethylsiloxane) can be used as the high boiling point organic solvent. The silicone oil is described in Japanese Patent Provisional Publication Nos. 62(1987)-215953,.63 (1988)-46449.

[Polymer latex]

The polymer latex can be added to the coating layers (including a backing layer) of the image recording medium. The addition of the polymer latex has effects of improving dimensional stability, inhibiting curl, inhibiting adhesion or preventing the layer from cracking. A polymer having a low glass transition temperature (lower than 40° C.) has an excellent function of inhibiting curl or preventing the layer from cracking. The anticurl effect can also be obtained by adding a polymer having a high glass transition temperature to a backing layer. The polymer latex is described in Japanese Patent Provisional Publication Nos. 62(1987)-245258, 62(1987)-110066, 62(1987)-1316648.

[Discoloration inhibitor]

The discoloration inhibitor can be added to the image recording medium. The discoloration inhibitor can be classified into antioxidants, ultraviolet absorbents and metal complexes.

Examples of the antioxidants include chroman compounds, coumaran compounds, phenol compounds (e.g., hindered phenol), hydroquinone compounds, hindered amine derivatives and spiroindan compounds. The antioxidants are described in Japanese Patent Provisional Publication No. 61(1986)-159644.

Examples of the ultraviolet absorbents include benzotriazole compounds (described in U.S. Pat. No. 3,533,794), 4-thiazolidone compounds (described in U.S. Pat. No. 3,352,681), benzophenone compounds (described in Japanese Patent Provisional Publication No. 46(1971)-2784) and ultraviolet absorbing polymers (described in Japanese Patent Provisional Publication No. 62(1987)-260152).

The metal complexes are described in U.S. Pat. Nos. 4,241,155, 4,245,018, 4,254,195, and Japanese Patent Provisional Publication Nos. 61(1986)-88256, 62(1987)-174741, 63(1988)-199248, 1(1989)-75568, 1(1989)-74272.

[Brightening agent]

The brightening agent can be added to the image recording medium.

Examples of the brightening agents include stilbene compounds, coumarin compounds, biphenyl compounds, benzoxazolyl compounds, naphthalimide compounds, pyrazoline compounds and carbostyryl compounds. The brightening agents are described in K. Veenkataraman, The Chemistry of Synthetic Dyes, Vol. 5, Chapter 8 and Japanese Patent Provisional Publication No. 61(1986)-143752.

[Image recording process]

The image recording medium is used in a process of imagewise attaching an aqueous ink onto the surface gelatin layer of the image recording medium, whereby the applied aqueous ink penetrates into the surface gelatin layer and the polyvinyl alcohol layer and the ink is fixed in the polyvinyl alcohol layer to record an image. The image recording process can be conducted according to a method of releasing and accepting a dye, such as an ink jet method, a thermal sublimation transfer method or a dye diffusion transfer method. The image recording medium of the present invention is particularly effective in the ink jet method.

The ink jet method can be classified into a continuous type and an on-demand type. The ink jet head can be classified into a piezo type, a bubble jet type, a thermal jet type and a supersonic wave type.

Various improvements have been introduced into the ink jet method. For example, many and small droplets of light color ink (photo ink) are jetted to a recording medium to improve the resolution. Two or more inks having the same hue but different densities are used to improve the image quality. A transparent ink is used to reproduce a specific image.

The present invention is particularly effective in an ink jet printer showing a fast printing speed. The invention is also effective in an ink jet printer jetting a large amount (not less than 10 ml per $m^2$) of a light color ink.

Further, the number of the ink colors has recently been increased to improve the image quality. For example, the number is increased from 3 (yellow, magenta, cyan) or 4 (yellow, magenta, cyan, black) to 6 (yellow, dark magenta, light magenta, dark cyan, light cyan, black). The present invention is particularly effective in a color ink jet printer using many (6 or more) inks.

EXAMPLE 1

(Support)

A fine paper (density: 1.053, thickness: 152 μm) made of a pulp mixture (LBKP/NBSP=6/4) was used as a support.

(Formation of polyolefin layers)

On both surfaces of the support, a polyethylene was laminated at 300° C. according to an extrusion coating method to form (back and front) polyolefin layers. The back polyolefin layer was made of high density polyethylene (density: 0.955). The front polyolefin layer was made of polyethylene (density: 0.923) mixed with titanium dioxide particles (white pigment) and bluish and reddish ultramarine (coloring pigment, Daiichi Chemical Industries Co., Ltd.). The thickness of the front polyolefin layer was 36 μm, and the thickness of the back polyolefin layer was 27 μm.

(Formation of gelatin and polyvinyl alcohol layers)

On the front polyolefin layer, the following layers were simultaneously coated to prepare a sample No. 101.

| Undercoating gelatin layer (thickness: 1.1 μm) | |
|---|---|
| Alkali treated gelatin | 1.0 g/$m^2$ |
| The compound UV-01 (brightening agent) | 0.03 g/$m^2$ |
| The compound H-02 (hardening agent) | 0.08 g/$m^2$ |
| $Na_2B_2O_4.4H_2O$ | 0.08 g/$m^2$ |
| The compound W-04 (surface active agent) | 0.02 g/$m^2$ |
| The compound F-08 (antiseptic) | 0.001 g/$m^2$ |

(UV-01)

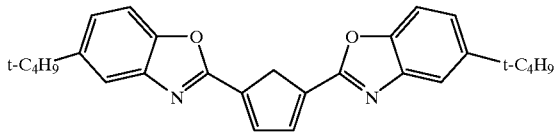

(H-02)

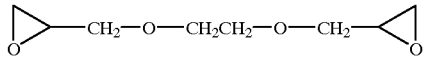

-continued (W-04)

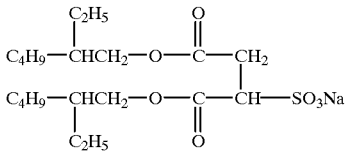

(F-08)

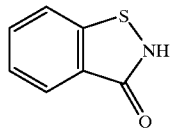

Polyvinyl alcohol layer (thickness: 12 μm)

| | |
|---|---|
| The polymer mordant (CPM-17) | 3.0 g/m$^2$ |
| Polyvinyl alcohol (saponification degree: 82 mole %, average polymerization degree: 500) | 9.0 g/m$^2$ |
| The compound W-04 (surface active agent) | 0.06 g/m$^2$ |

Surface gelatin layer (average thickness: 0.4 μm)

| | |
|---|---|
| Alkali treated gelatin | 0.3 g/m$^2$ |
| Polymethyl methacrylate particles (matting agent, average particle size: 3.5 μm) | 0.18 g/m$^2$ |
| The compound W-04 (surface active agent) | 0.02 g/m$^2$ |
| The compound W-07 (surface active agent) | 0.02 g/m$^2$ |
| The compound F-08 (antiseptic) | 0.002 g/m$^2$ |

(W-07)

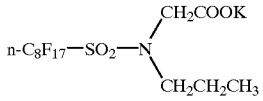

A comparative sample No. 102 was prepared in the same manner as in the preparation of the sample No. 101, except that the polymer mordant CPM-17 was used in place of the polyvinyl alcohol used in the polyvinyl alcohol layer. The total amount of the polymer mordant contained in the layer was 12.0 g/m$^2$.

A sample No. 103 was prepared in the same manner as in the preparation of the sample No. 101, except that another polyvinyl alcohol (saponification degree: 88 mole %, average polymerization degree: 500) was used in the polyvinyl alcohol layer.

A comparative sample No. 104 was prepared in the same manner as in the preparation of the sample No. 101, except that another polyvinyl alcohol (saponification degree: 98 mole %, average polymerization degree: 500) was used in the polyvinyl alcohol layer.

A sample No. 105 was prepared in the same manner as in the preparation of the sample No. 101, except that another polyvinyl alcohol (saponification degree: 71 mole %, average polymerization degree: 500) was used in the polyvinyl alcohol layer.

A sample No. 106 was prepared in the same manner as in the preparation of the sample No. 101, except that another polyvinyl alcohol (saponification degree: 55 mole %, average polymerization degree: 500) was used in the polyvinyl alcohol layer.

Sample Nos. 111, 112, 114 and 116 were prepared in the same manner as in the preparation of the sample Nos. 101, 102, 104 and 106 respectively, except that the polyolefin layers were not formed.

The sample Nos. 101 to 106, 111, 112, 114 and 116 were left for 1 week at the room temperature. The samples were cut into pieces of a postcard size (length: 14.5 cm, width: 10 cm). A photographic image was printed on each of the samples by using an ink jet color printer (MJ-910, Seiko Epson Co., Ltd.). The image had been photographed with a camera (EOS-10, Canon Inc.) on a color reversal film (Provia 100, Fuji Photo Film Co., Ltd.), and scanned to obtain a digital information. The image was repeatedly formed concerning twenty categories such as landscape, nature, portrait, fashion and still life. The categories were selected in consideration of a distribution of objects of an amateur photographer.

The printed samples were evaluated about the gloss (similarity to photograph), the granular stain (beads-like stain caused by contamination between neighboring two inks), the color hue (similarity to original) and the total image quality. The results were classified into five grades of 1 (inferior) to 5 (the most excellent). The evaluation was conducted by ten judges. The five judges were researchers of photography worked at the Ashigara Laboratories of Fuji Photo Film Co., Ltd. The other five judges were developers of photography worked at the Ashigara Laboratories. The evaluations of the ten judges were averaged. The results are set forth in Table 1. In the Table 1, the column of "Mole % of PVA" indicates the saponification degree (the amount of vinyl alcohol units) of polyvinyl alcohol.

TABLE 1

| Sample No. | Poly-olefin | Mole % of PVA | Gloss | Stain | Color hue | Total quality |
|---|---|---|---|---|---|---|
| 101 | Formed | 82% | 4.8 | 4.2 | 4.0 | 4.2 |
| 102 | Formed | None | 4.0 | 2.0 | 2.0 | 2.8 |
| 103 | Formed | 88% | 4.6 | 4.0 | 4.0 | 4.0 |
| 104 | Formed | 98% | 4.0 | 3.0 | 3.8 | 3.6 |
| 105 | Formed | 71% | 4.6 | 4.0 | 4.0 | 4.0 |
| 106 | Formed | 55% | 4.4 | 4.0 | 3.0 | 3.6 |
| 111 | None | 82% | 1.2 | 3.8 | 3.8 | 2.2 |
| 112 | None | None | 0.8 | 1.6 | 1.8 | 1.6 |
| 114 | None | 98% | 0.8 | 1.8 | 3.4 | 2.0 |
| 116 | None | 55% | 1.0 | 3.6 | 2.6 | 2.0 |

EXAMPLE 2

Comparative experiments were conducted in the same manner as in Example 1, except that a color ink jet printer (PM-700C, Seiko Epson Co., Ltd.) using six inks (yellow, dark magenta, light magenta, dark cyan, light cyan and black) was used in place of the ink jet printer of Example 1 using four inks (yellow, magenta, cyan and black). The results were analogous to the results of Example 1, except that the effects of the present invention were more remarkable.

EXAMPLE 3

Comparative experiments were conducted in the same manner as in Example 1, except that a color ink jet printer (continuous type bobble jet method, BJ-420, Canon Inc.) was used in place of the ink jet printer of Example 1 (on demand type piezo method). The results were analogous to the results of Example 1.

EXAMPLE 4

A comparative sample No. 142 was prepared in the same manner as in the preparation of the sample No. 101 of Example 1, except that polymethyl methacrylate particles (average particle size: 2.5 μm) were used as the matting agent added to the surface gelatin layer in place of the particles (average particle size: 3.5 μm). The amount of the particles was the same as in Example 1.

A sample No. 143 was prepared in the same manner as in the preparation of the sample No. 101 of Example 1, except that polymethyl methacrylate particles (average particle size: 7.8 μm) were used as the matting agent added to the surface gelatin layer in place of the particles (average particle size: 3.5 μm). The amount of the particles was the same as in Example 1.

A sample No. 144 was prepared in the same manner as in the preparation of the sample No. 101 of Example 1, except that polymethyl methacrylate particles (average particle size: 12 μm) were used as the matting agent added to the surface gelatin layer in place of the particles (average particle size: 3.5 μm). The amount of the particles was the same as in Example 1.

A comparative sample No. 145 was prepared in the same manner as in the preparation of the sample No. 101 of Example 1, except that the surface gelatin layer was not formed.

Comparative sample Nos. 152, 153, 154 and 155 were prepared in the same manner as in the preparation of the sample Nos. 142, 143, 144 and 145 respectively, except that the polyolefin layers were not formed.

An image was printed on each of the sample Nos. 101, 142, 143, 144, 145, 152, 153, 154 and 155 in the same manner as in Example 2.

After 3 minutes, a white paper was pressed on the printed sample, and peeled from the sample. The ink transference from the sample to the white paper was observed. The ink transference ware evaluated into four grades of A (not transferred) to D (remarkably transferred). Further, the surface adhesion was examined by touching the surface with a hand. The surface adhesion was evaluated into three grades of A (not recognized) to C (remarkably recognized). Furthermore, the gloss of the image was evaluated. The results are set forth in Table 2. In the Table 2, the column of "Matting agent" indicates the average particle size of the solid particles added to the surface gelatin layer.

TABLE 2

| Sample No. | Poly-olefin | Matting agent | Trans-ference | Surface adhesion | Gloss of image |
|---|---|---|---|---|---|
| 101 | Formed | 3.5 μm | B | B | Observed |
| 142 | Formed | 2.5 μm | C | B | Observed |
| 143 | Formed | 7.8 μm | B | B | Observed |
| 144 | Formed | 12 μm | A | A | Observed |
| 145 | Formed | None | D | C | Observed |
| 152 | None | 2.5 μm | C | B | None |
| 153 | None | 7.8 μm | B | B | None |
| 154 | None | 12 μm | A | A | None |
| 155 | None | None | D | C | None |

COMPARISON EXAMPLE 1

A white polyethylene terephthalate film containing titanium dioxide was used as the support. On the support, the undercoating gelatin layer, the polyvinyl alcohol layer and the surface gelatin layer was formed (without forming the polyolefin layer) in the same manner as in Example 1.

An image was recorded on the obtained image recording medium in the same manner as in Example 1. The obtained image was somewhat different from a photographic image about feeling, touch, gloss and cubic effect.

EXAMPLE 5

(Support)

A fine paper (density: 1.053, thickness: 152 μm) made of a pulp mixture (LBKP/NBSP=6/4) was used as a support.

(Formation of polyolefin layers)

On both surfaces of the support, a polyethylene was laminated at 300° C. according to an extrusion coating method to form (back and front) polyolefin layers. The back polyolefin layer was made of high density polyethylene (density: 0.955). The front polyolefin layer was made of polyethylene (density: 0.923) mixed with titanium dioxide particles (white pigment) and bluish and reddish ultramarine (coloring pigment, Daiichi Chemical Industries Co., Ltd.). The thickness of the front polyolefin layer was 36 μm, and the thickness of the back polyolefin layer was 27 μm.

(Formation of gelatin and polyvinyl alcohol layers)

On the front polyolefin layer, the following layers were simultaneously coated to prepare a sample No. 901.

| | |
|---|---|
| Undercoating gelatin layer (thickness: 1.1 μm) | |
| Alkali treated gelatin | 1.0 g/m$^2$ |
| The compound UV-01 (brightening agent) | 0.03 g/m$^2$ |
| The compound H-02 (hardening agent) | 0.08 g/m$^2$ |
| The compound W-04 (surface active agent) | 0.02 g/m$^2$ |
| The compound F-08 (antiseptic) | 0.001 g/m$^2$ |
| Polyvinyl alcohol layer (thickness: 12 μm) | |
| The polymer mordant (CPM-17) | 3.0 g/m$^2$ |
| Polyvinyl alcohol (saponification degree: 78 mole %, average polymerization degree: 505) | 9.0 g/m$^2$ |
| The compound W-04 (surface active agent) | 0.06 g/m$^2$ |
| Surface gelatin layer (average thickness: 0.5 μm) | |
| Alkali treated gelatin | 0.3 g/m$^2$ |
| Polymethyl methacrylate particles (matting agent, average particle size: 30 μm) | 0.18 g/m$^2$ |
| The compound W-04 (surface active agent) | 0.02 g/m$^2$ |
| The compound W-07 (surface active agent) | 0.02 g/m$^2$ |
| The compound F-08 (antiseptic) | 0.002 g/m$^2$ |

Sample Nos. 902 to 904 were prepared in the same manner as in the preparation of the sample No. 901, except that the thickness of the surface gelatin layer was changed as is shown in Table 3.

A comparative sample No. 905 was prepared in the same manner as in the preparation of the sample No. 901, except that the surface gelatin layer was not formed.

Sample Nos. 906 to 909 were prepared in the same manner as in the preparation of the sample No. 901, except that the thickness of the polyvinyl alcohol layer was changed as is shown in Table 3.

A comparative sample No. 910 was prepared in the same manner as in the preparation of the sample No. 901, except that the polyvinyl alcohol layer was not formed and the thickness of the surface gelatin layer was changed as is shown in Table 3.

The sample Nos. 901 to 910 were left for 1 week at the room temperature (25° C.). The samples were cut into pieces of a postcard size (length: 14.5 cm, width: 10 cm). An image was printed on each of the samples by using a color ink jet printer (PM-700C, Seiko Epson Co., Ltd.).

The printed samples were evaluated about the granular stain (beads-like stain caused by contamination between neighboring two inks). The results were classified into five grades of 1 (inferior) to 5 (the most excellent). The evaluation was conducted by ten judges, who were researchers of photography worked at the Ashigara Laboratories of Fuji Photo Film Co., Ltd. The evaluations of the ten judges were averaged.

Further, the printed image (after 2 minutes) was pressed on a back surface of the image recording medium at the pressure of 10 g per m$^2$ over one night. The ink transference (drying of ink) was evaluated from the adhesion mark. The evaluation (five grades) was conducted by ten judges, who were researchers of photography worked at the Ashigara in the same manner as in the evaluation of the granular stain. The evaluations of the ten judges were averaged.

Furthermore, the coated surface condition of the image recording medium (wind pattern caused when the layer was coated) was evaluated into three grades of A (excellent) to C (inferior).

The results are set forth in Table 3. In the Table 3, the column of "PVA layer" indicates the thickness of the polyvinyl alcohol layer, and the column of "Gelatin layer" indicates the thickness of the surface gelatin layer.

TABLE 3

| Sample No. | PVA layer | Gelatin layer | Granular stain | Ink drying | Coated surface |
|---|---|---|---|---|---|
| 901 | 12 μm | 0.7 μm | 4.3 | 3.4 | A |
| 902 | 12 μm | 1.7 μm | 3.7 | 3.2 | A |
| 903 | 12 μm | 2.3 μm | 2.8 | 2.5 | C |
| 904 | 12 μm | 0.1 μm | 4.3 | 2.5 | C |
| 905 | 12 μm | None | 4.4 | 2.5 | C |
| 907 | 6 μm | 0.7 μm | 4.4 | 3.8 | A |
| 908 | 4 μm | 0.7 μm | 4.0 | 3.3 | A |
| 909 | 2 μm | 0.7 μm | 2.2 | 2.0 | A |
| 910 | None | 12 μm | 0.2 | 0.2 | A |

EXAMPLE 6

The sample Nos. 911 to 915 were prepared in the same manner as in the preparation of the sample No. 901 of the Example 5, except that the saponification degree and the average polymerization degree of the polyvinyl alcohol were changed as is shown in Table 4.

The samples were evaluated in the same manner as in Example 5. The results are set forth in Table 4.

TABLE 4

| Sample No. | Saponification | Polymerization | Granular stain | Ink drying | Coated surface |
|---|---|---|---|---|---|
| 901 | 78% | 505 | 4.3 | 3.4 | A |
| 911 | 85% | 510 | 3.2 | 3.1 | A |
| 912 | 98% | 495 | 1.8 | 1.8 | A |
| 913 | 78% | 1,500 | 4.4 | 4.2 | A |
| 914 | 78% | 2,000 | 4.3 | 4.4 | B |
| 915 | 78% | 3,500 | 4.2 | 4.4 | B |

EXAMPLE 7

(Support)

A fine paper (density: 1.053, thickness: 152 μm) made of a pulp mixture (LBKP/NBSP=6/4) was used as a support.

(Formation of polyolefin layers)

On both surfaces of the support, a polyethylene was laminated at 300° C. according to an extrusion coating method (back and front) polyolefin layers. The back polyolefin layer was made of high density polyethylene (density: 0.955). The front polyolefin layer was made of poltethylene (density: 0.923) mixed with titanium dioxide particles (white pigment) and bluish and reddish ultramarine (coloring pigment, Daiichi Chemical Industries Co., Ltd.). The thickness of the front polyolefin layer was 36 μm, and the thickness of the back polyolefin layer was 27 μm.

(Formation of gelatin and polyvinyl alcohol layers)

On the front polyolefin layer, the following layers were simultaneously coated to prepare a sample No. 924.

| | |
|---|---|
| Undercoating gelatin layer (thickness: 1.1 μm) | |
| Alkali treated gelatin | 1.0 g/m$^2$ |
| The compound UV-01 (brightening agent) | 0.03 g/m$^2$ |
| The compound H-02 (hardening agent) | 0.08 g/m$^2$ |
| The compound W-04 (surface active agent) | 0.02 g/m$^2$ |
| The compound F-08 (antiseptic) | 0.001 g/m$^2$ |
| Second polyvinyl alcohol layer (thickness: 6 μm) | |
| The polymer mordant (CPM-17) | 1.5 g/m$^2$ |
| Polyvinyl alcohol (saponification degree: 78 mole %, average polymerization degree: 500) | 4.5 g/m$^2$ |
| The compound W-04 (surface active agent) | 0.1 g/m$^2$ |
| Intermediate gelatin layer (average thickness: 0.1 μm) | |
| Alkali treated gelatin | 0.1 g/m$^2$ |
| The compound W-04 (surface active agent) | 0.01 g/m$^2$ |
| First polyvinyl alcohol layer (thickness: 6 μm) | |
| The polymer mordant (CPM-17) | 1.5 g/m$^2$ |
| Polyvinyl alcohol (saponification degree: 78 mole %, average polymerization degree: 2,000) | 4.5 g/m$^2$ |
| The compound W-04 (surface active agent) | 0.1 g/m$^2$ |
| Surface gelatin layer (average thickness: 0.5 μm) | |
| Alkali treated gelatin | 0.3 g/m$^2$ |
| Polymethyl methacrylate particles (matting agent, average particle size: 30 μm) | 0.18 g/m$^2$ |
| The compound W-04 (surface active agent) | 0.02 g/m$^2$ |
| The compound W-07 (surface active agent) | 0.02 g/m$^2$ |
| The compound F-08 (antiseptic) | 0.002 g/m$^2$ |

A sample No. 925 was prepared in the same manner as in the preparation of the sample No. 924, except that the average polymerization degree of the polyvinyl alcohol contained in the first polyvinyl alcohol layer was changed as is shown in Table 5.

Sample Nos. 934 and 935 were prepared in the same manner as in the preparation of the sample Nos. 924 and 925 respectively, except that the thickness of the intermediate gelatin layer was changed to 0.5 μm.

Sample Nos. 944 and 945 were prepared in the same manner as in the preparation of the sample Nos. 924 and 925 respectively, except that the thickness of the intermediate gelatin layer was changed to 2.2 μm.

The samples were evaluated in the same manner as in Example 5. The results are set forth in Table 5. In the Table 5, the column of "Intermediate" indicates the thickness of the intermediate gelatin layer.

TABLE 5

| Sample No. | Polymerization | Intermediate | Granular stain | Ink drying | Coated surface |
|---|---|---|---|---|---|
| 914 | 2,000 | None | 4.3 | 4.4 | B |
| 915 | 3,500 | None | 4.2 | 4.4 | B |
| 924 | 2,000 | 0.1 μm | 4.2 | 4.4 | B |
| 925 | 3,500 | 0.1 μm | 4.2 | 4.4 | B |
| 934 | 2,000 | 0.5 μm | 4.0 | 4.5 | A |
| 935 | 3,500 | 0.5 μm | 4.0 | 4.3 | A |
| 944 | 2,000 | 2.2 μm | 3.5 | 3.2 | A |
| 945 | 3,500 | 2.2 μm | 3.4 | 3.0 | A |

We claim:

1. An image recording medium which comprises a support, a polyolefin layer, a polyvinyl alcohol layer and a surface gelatin layer in the order, said polyolefin layer containing polyolefin in an amount of not less than 50 wt. %, said polyolefin layer having a thickness in the range of 10 to 100 μm, said polyvinyl alcohol layer containing a vinyl alcohol polymer in an amount of not less than 50 wt. %, said vinyl alcohol polymer comprising vinyl alcohol units in an amount of 50 to 90 mole %, said polyvinyl alcohol layer having a thickness in the range of 2 to 20 μm, said surface gelatin layer containing gelatin in an amount of not less than 50 wt. %, said surface gelatin layer having a thickness in the range of 0.2 to 2 μm, said surface gelatin layer further containing solid particles, and said solid particles having an average particle size in the range of 3 to 100 μm.

2. The image recording medium as claimed in claim 1, wherein the vinyl alcohol polymer of the polyvinyl alcohol layer has an average polymerization degree of not less than 1,000, and the image recording medium further comprises a second polyvinyl alcohol layer between the polyolefin layer and the polyvinyl alcohol layer, said second polyvinyl layer containing a vinyl alcohol polymer in an amount of not less than 50 wt. %, said second polyvinyl alcohol layer having a thickness in the range of 2 to 20 μm, said vinyl alcohol polymer of the second polyvinyl alcohol layer comprising vinyl alcohol units in an amount of 50 to 90 mole %, and said vinyl alcohol polymer of the second polyvinyl alcohol layer having an average polymerization degree of less than 1,000.

3. The image recording medium as claimed in claim 2, wherein the image recording medium further comprises an undercoating gelatin layer between the polyolefin layer and the second polyvinyl alcohol layer, said undercoating gelatin layer containing gelatin in an amount of 50 to 90 mole %, and said undercoating gelatin layer having a thickness in the range of 0.5 to 5 μm.

4. The image recording medium as claimed in claim 2, wherein the second polyvinyl alcohol layer further contains a polymer mordant.

5. The image recording medium as claimed in claim 1, wherein the image recording medium further comprises a second polyvinyl alcohol layer between the polyolefin layer and the polyvinyl alcohol layer, said second polyvinyl layer containing a vinyl alcohol polymer in an amount of not less than 50 wt. %, said second polyvinyl alcohol layer having a thickness in the range of 2 to 20 μm, said vinyl alcohol polymer of the second polyvinyl alcohol layer comprising vinyl alcohol units in an amount of 50 to 90 mole %, and the image recording medium furthermore comprises an intermediate gelatin layer between the second polyvinyl alcohol layer and the polyvinyl alcohol layer, said intermediate gelatin layer containing gelatin in an amount of not less than 50 wt. %, and said intermediate gelatin layer having a thickness in the range of 0.2 to 2 μm.

6. The image recording medium as claimed in claim 5, wherein the image recording medium further comprises an undercoating gelatin layer between the polyolefin layer and the second polyvinyl alcohol layer, said undercoating gelatin layer containing gelatin in an amount of 50 to 90 mole %, and said undercoating gelatin layer having a thickness in the range of 0.5 to 5 μm.

7. The image recording medium as claimed in claim 5, wherein the vinyl alcohol polymer of the polyvinyl alcohol layer has an average polymerization degree of not less than 1,000, and the vinyl alcohol polymer of the second polyvinyl alcohol layer has an average polymerization degree of less than 1,000.

8. The image recording medium as claimed in claim 5, wherein the second polyvinyl alcohol layer further contains a polymer mordant.

9. The image recording medium as claimed in claim 1, wherein the image recording medium further comprises an undercoating gelatin layer between the polyolefin layer and the polyvinyl alcohol layer, said undercoating gelatin layer containing gelatin in an amount of 50 to 90 mole %, and said undercoating gelatin layer having a thickness in the range of 0.5 to 5 μm.

10. The image recording medium as claimed in claim 1, wherein the solid particles have an average particle size in the range of 10 to 100 μm.

11. The image recording medium as claimed in claim 1, wherein the polyvinyl alcohol layer further contains a polymer mordant.

12. An image recording process comprising imagewise attaching an aqueous ink onto a surface gelatin layer of an image recording medium which comprises a support, a polyolefin layer, a polyvinyl alcohol layer and the surface gelatin layer in the order, said polyolefin layer containing polyolefin in an amount of not less than 50 wt. %, said polyolefin layer having a thickness in the range of 10 to 100 μm, said polyvinyl alcohol layer containing a vinyl alcohol polymer in an amount of not less than 50 wt. %, said vinyl alcohol polymer comprising vinyl alcohol units in an amount of 50 to 90 mole %, said polyvinyl alcohol layer having a thickness in the range of 2 to 20 μm, said surface gelatin layer containing gelatin in an amount of not less than 50 wt. %, said surface gelatin layer having a thickness in the range of 0.2 to 2 μm, said surface gelatin layer further containing solid particles, and said solid particles having an average particle size in the range of 3 to 100 μm, whereby the applied aqueous ink penetrates into the surface gelatin layer and the polyvinyl alcohol layer and the ink is fixed in the polyvinyl alcohol layer to record an image in the image recording medium.

13. The image recording process as claimed in claim 12, wherein the aqueous ink is imagewise attached onto the surface gelatin layer by using an ink jet printer.

14. The image recording process as claimed in claim 13, wherein the amount of the ink is not less than 10 ml per 1 $m^2$ of the surface gelatin layer.

15. The image recording process as claimed in claim 13, wherein each of a yellow ink, a dark magenta ink, a light magenta ink, a dark cyan ink, a light cyan ink and a black ink is imagewise attached to the surface gelatin layer to record a color image.

* * * * *